United States Patent [19]

Graham

[11] Patent Number: 4,631,773

[45] Date of Patent: Dec. 30, 1986

[54] APPARATUS FOR REMOVING FINES FROM COPPER WIRES

[75] Inventor: Randall C. Graham, Nashville, Tenn.

[73] Assignee: Essex Group, Inc., Fort Wayne, Ind.

[21] Appl. No.: 789,813

[22] Filed: Oct. 21, 1985

[51] Int. Cl.[4] ..... B21B 45/02; B21C 43/00; A46B 13/04

[52] U.S. Cl. ..... 15/4; 15/88; 15/97 R; 72/40; 118/72; 134/9

[58] Field of Search ..... 15/77, 88, 97 R, 4; 29/81 H, 81 J, 33 F, DIG. 7, DIG. 14; 118/72, DIG. 21; 72/40; 134/9

[56] References Cited

U.S. PATENT DOCUMENTS 3,102,056 8/1963 Peterson ..... 15/88 X 3,702,489 11/1972 Nakamura et al. ..... 15/88

*Primary Examiner*—Edward L. Roberts

*Attorney, Agent, or Firm*—Robert D. Sommer

[57] ABSTRACT

Apparatus for removing fines from a plurality of copper wires advancing generally upwardly in a common plane, comprising three brush rollers each having a generally cylindrical outer brushing surface of a fur-like fine pile material in brushing contact with the wires. Two of the rollers are disposed one above the other at one side of the plane of wire advancement and the third roller is disposed on the opposite side of the plane of wire advancement in brushing contact with the wires along an area intermediate the areas of brushing contact of the other two rollers with the wires. The apparatus also comprises spray means to discharge a spray of liquid at the contact area between the uppermost roller and the wires, and means for rotating the rollers in a direction opposite to the direction of wire advancement at a speed sufficient to throw off fines removed from the wires by the rollers. The apparatus further comprises means for collecting the liquid discharged by the spray means, means for filtering fines from the collected liquid, and means to return the filtered fluid to the spray means. Wiping means are provided to remove liquid from the wires as they advance away from the uppermost roller.

7 Claims, 5 Drawing Figures

FIG. 3
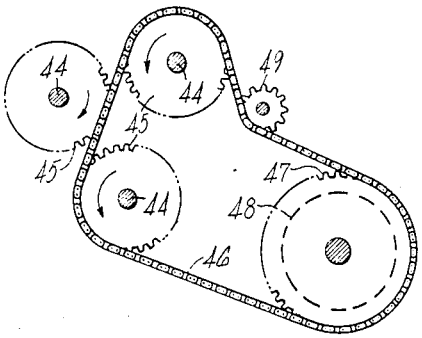
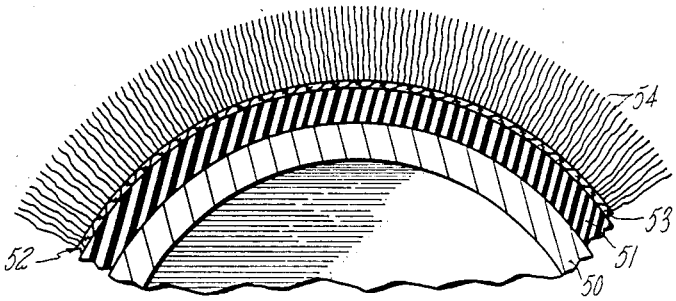
FIG. 4

APPARATUS FOR REMOVING FINES FROM COPPER WIRES

TECHNICAL FIELD

This invention relates to apparatus for cleaning wire and more particularly to apparatus for removing fines from the outer surfaces of a plurality of bare copper wires which are advancing in substantially parallel and straight paths.

BACKGROUND OF THE INVENTION

In a known method of producing insulated electric wire such as magnet wire by continuously drawing and coating copper wire, copper wire is cold-drawn through a series of dies to a desired small diameter and then passed through an annealing apparatus. After leaving the annealing apparatus, the wire proceeds through a quenching apparatus which includes a water containing quench pan having sponge wipers at its exit end for wiping the wire free of water as it leaves the quenching apparatus. From the quenching apparatus, the wire is directed generally upwardly to the top of a vertical curing oven which has an enamel applicator unit at its lower end. A number of downward and upward passes of the wire are made through the curing oven with the enamel applicator unit applying liquid enamel to the wire upon upward passes thereof before the wire reenters the curing oven. As many as twenty wires may be advanced through the annealing apparatus and the quenching apparatus to the curing oven in parallel, side-by-side relationship.

During the wire drawing operation, copper fines, i.e. small particles or slivers of copper, are deposited on the outer surfaces of the wires. As these fines pass with the wires through the annealing apparatus, the quenching apparatus and the curing oven, they create a number of problems. The accumulation of fines in the sponge wipers at the quenching apparatus requires daily replacement of the sponge wipers. At the top of the curing oven, the fines cause a large housekeeping problem as they fall off the wires onto the equipment at that location. Other fines travel with the wires through the curing oven and build up in the dies of the enamel applicator unit where they can occasionally break off in globs or lumps affixed to a wire or cause breakage of a wire by clogging a die. The fines also interfere with proper adhesion of liquid enamel to the bare copper wires. Various faults in the enamel coating of the wires such as slivers, beads and discontinuitites result from the presence of fines on the wires.

To alleviate the problems created by copper fines, felt pads have been employed to wipe fines from the wires after they leave the quenching apparatus. Although these felt pad wipers are somewhat effective in reducing the quantity of fines carried by the wires, they, like the quench sponges, become littered with fines and must be replaced daily. Thus, a need exists for a convenient apparatus which can effectively remove fines from a plurality of small diameter copper wires without the need for first wiping quenching water from the wires and without the need for frequent replacement of its cleaning elements.

It is known to remove scale and other foreign material from wire material with rotating brushes in rubbing contact with the wire material. Such an expedient is disclosed in U.S. Pat. No. 3,702,489 wherein three rotating brushes are disposed in angularly and axially spaced relationship with each other along the path of wire material advancement. The brushes of wire bristles employed in this arrangement are entirely unsuitable for removing fines from thin copper wires of about 0.5 to 1.0 mm diameter. Moreover, it would be uneconomical and impractical to provide a set of three rotating brushes for each of the twenty closely spaced wires advancing from a quenching apparatus.

SUMMARY OF THE INVENTION

The present invention provides an improved apparatus of compact design for effectively and economically removing fines from a plurality of thin copper wires advancing generally upwardly in a common plane from a quenching apparatus which does not require prior wiping of the quenching water from the wires. According to this invention, there are provided three brush rollers each having a generally cylindrical outer brushing surface of a fur-like fine pile material in brushing contact with the wires. Two of the rollers are disposed one above the other at one side of the plane of wire advancement and the third roller is disposed on the opposite side of the plane of wire advancement in brushing contact with the wires along an area intermediate the areas of brushing contact of the other two rollers with the wires. Nozzle spray means are provided to discharge a spray of liquid at the contact area between the uppermost roller and the wires to flush fines from that roller and to facilitate the brushing action of all the rollers. The rollers are rotated in a direction opposite to the direction of wire advancement at a speed sufficient to throw off the fines removed from the wires by the brushes.

In a preferred embodiment of the invention, the brush rollers and spray nozzle means are disposed within a chamber defined by a housing that has aligned openings in its top and bottom walls for passage of the wires through the chamber. The apparatus also includes means for collecting liquid discharged in the chamber and filtering fines from the fines-laden liquid for recirculation of the filtered liquid to the spray nozzle means. The apparatus further includes liquid wiping means disposed above the housing to wipe and absorb liquid from the wires after they leave the chamber.

For a better understanding of the invention, reference may be had to the following detailed description taken in connection with the accompanying drawings, in which:

BRIEF DESCRIPTION OF THE DRAWINGS

FIG. 3 is a fragmentary plan view showing a drive arrangement for the brush rollers employed in the fines removing apparatus;

FIG. 4 is an enlarged partial sectional view of a brush roller employed in the fines removing apparatus.

BEST MODE FOR CARRYING OUT THE INVENTION

Figure 1:
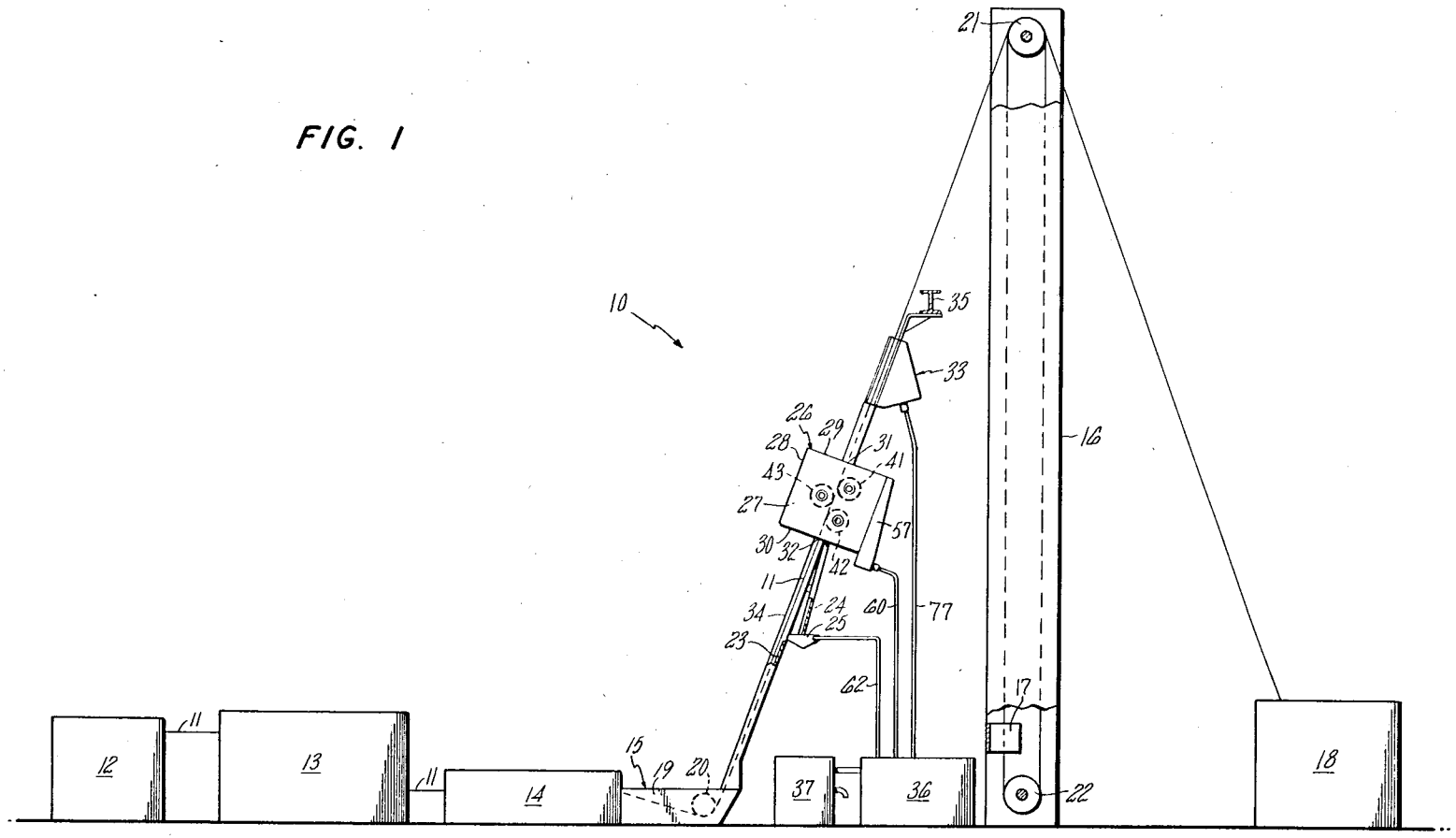
FIG. 1 is a diagrammatic view of fines removing apparatus according to the present invention shown associated with wire drawing and enameling machinery.
Figure 2:
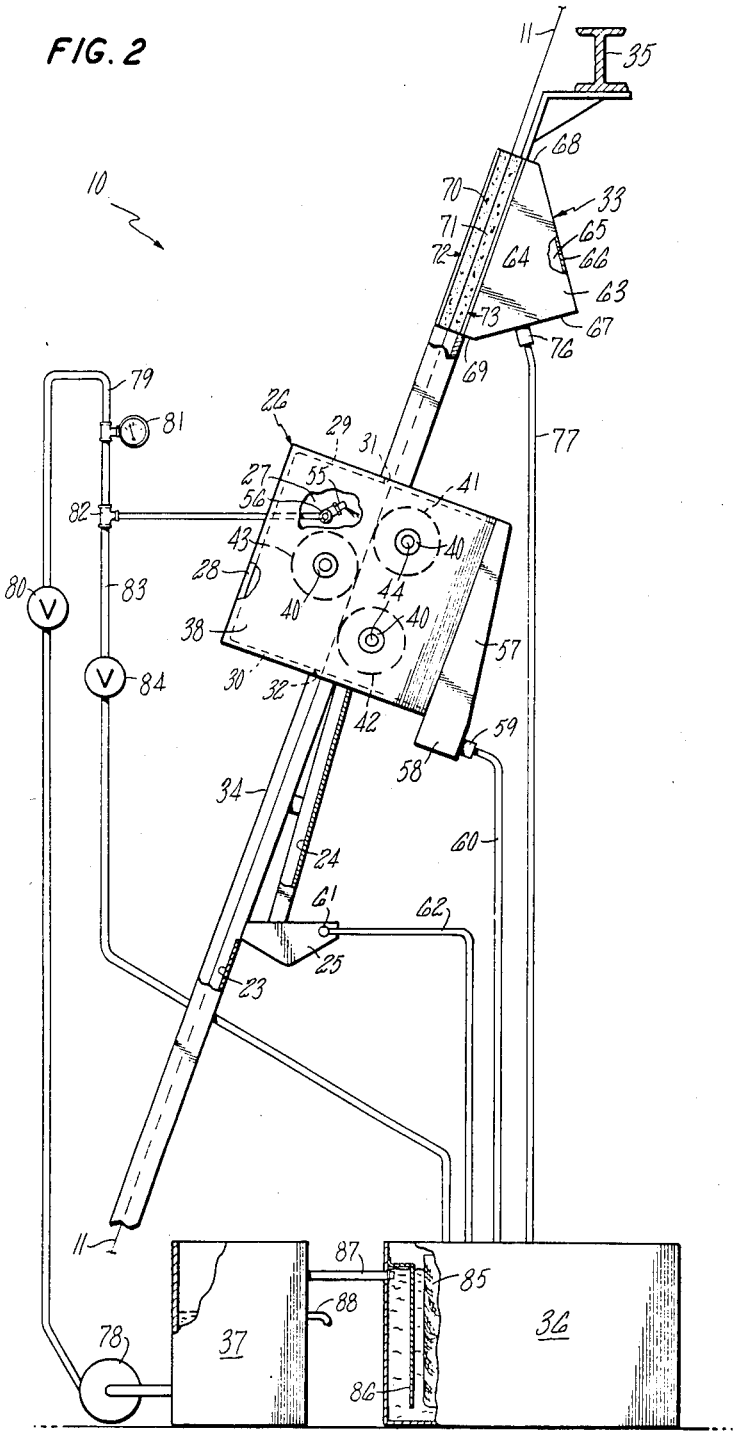
FIG. 2 is a side elevation of the fines removing apparatus.

As illustrated diagrammatically in FIG. 1, the fines removing apparatus 10 of the present invention is show in conjunction with typical machinery for continuously drawing and coating copper wire 11 to produce enameled or insulated magnet wire. This machinery comprises a bare wire supply source 12, wire drawing machines 13 having a plurality of dies (not shown), a wire annealer 14, a wire cooling or quenching apparatus 15, a vertical curing oven 16 having an enamel applicator unit 17 at its lower end, and wire take-up means 18. Although only a single wire 11 is shown in FIG. 1, it will be appreciated that as many as twenty wires may be simultaneously withdrawn from the supply source 12 and cold drawn to a desired small diameter by a like number of wire drawing machines. The wires 11 proceed from the wire drawing machines 13 through the annealer 14 and then the quenching apparatus 15 in parallel side-by-side relationship. The quenching apparatus 15 includes a water containing quench pan or compartment 19 where the wires 11 are cooled from their annealing temperature.

From the quenching apparatus 15, the wires 11 pass around a sheave 20 and then generally upwardly to a top sheave 21 on the oven 16 in parallel side-by-side relationship in a common plane. Depending upon the height of the oven 16 and its location relative to the quenching apparatus 15, the path of advancement of the wires upwardly may be inclined about 20° from a vertical line. The wires 11 pass downwardly through the oven 16 from the top sheave 21 to and around a bottom sheave 22 beneath the oven 16 and then back through the enamel applicator unit 17 and the oven 16 to the top sheave 21. The wires 11 are progressively threaded upon the sheaves 21 and 20 to make a desired number of upward and downward passes through the oven 16. Each time the wires 11 pass upwardly from the bottom sheave 22, a thin film of liquid enamel is applied to the wires by the enamel applicator unit 17 and then dried or cured in the oven 16. After the required number of enamel coatings have been applied to the wires 11, the wires are directed to the wire take-up means 18 where the enameled wire is wound onto spools or reels (not shown).

The fines removing apparatus 10 of the present invention is positioned along the path of wire advancement between the quenching apparatus 15 and the curing oven 16. It will be appreciated that heretofore the wires 10 exiting the quenching apparatus 15 were wiped of quenching water by sponge wipers and then passed through felt pads in an attempt to remove the fines deposited on the wires during the drawing thereof in the wire drawing machines 13. The apparatus 10 is adapted to remove fines from the wires without prior wiping of quench water from the wires and may be provided with splashguard plates or panels 23 and 24 positioned along the path of wire advancement for deflecting water to the quench pan 19 and to a receptacle or drip tray 25, respectively.

The fines removing apparatus 10 comprises a box-like housing 26 inclined in the direction of wire advancement and defining a chamber 27 through which the wires 11 pass. The housing 26 has a removable cover 28 and includes top and bottom walls 29 and 30 having respective aligned upper and lower openings 31 and 32 for passage of wires through the chamber 27. A device 33 for wiping liquid from the wires 11 exiting from the chamber 27 is disposed above the housing top wall 29. The splashguard panels 23 and 24, the housing 26 and the wiping device 33 are shown supported by a frame structure 34 which is suitable secured to an overhead beam 35. A filter tank 36 and a sump tank or reservoir 37 are located adjacent the drip tray 25 and the housing 26 for a purpose to be subsequently described.

Referring now also to FIGS. 2–5, the chamber 27 of the housing 26 is bounded on its sides by two side walls 38 and 39. Bearings 40 are mounted on these walls 38 and 39 for rotatably supporting three brush rollers 41, 42 and 43 within the chamber 27. Shafts 44 of the rollers 41, 42 and 43 project from the side wall 39 and are keyed to sprockets 45 which are connected by a drive chain 46 to a drive sprocket 47 on the drive shaft of a variable speed motor 48. An idler sprocket 49 may be provided to take up slack in the chain 46. The brush rollers 41 and 42 are rotated by the motor 48 in the same direction opposite to the direction in which the brush roller 43 is rotated.

Each of the brush rollers 41, 42 and 43 comprises a cylindrical core member 50 of rigid metal covered by a layer 51 of elastomeric material such as noeprene of about 30 or 40 durometer. The covering layer 51 preferably has an outer diameter of about 90 mm and a uniform thickness of about 6½ mm. Snugly fitted over the covering layer 51 of each brush roller is a tubular sleeve 52 of a fur-like, fine pile material with radial fibrous hairs of soft and flexible resin. Each sleeve 52 comprises a backing or base 53 woven of synthetic fibers which has upstanding resilient long pile fibers or hairs 54 of plastic material such as polypropylene or nylon. A suitable material for the sleeve 52 is Product No. 0450 supplied by Cloth World of Nashville, Tenn. The fibers 54 of such material have a denier of about 2000 and a length of about 12.5 mm.

The sleeves 52 may be formed to a desired internal diameter by cutting strips of appropriate length and width from stock of the fur-like material and stitching or otherwise securing together the longitudinal edges of each strip. In applying a sleeve 52 onto the covering layer 51 of a brush roller, the sleeve 52 is initially rolled back or coiled upon itself, exposing its inner surface. The rolled back sleeve 52 is next slipped over one end of the covering layer 51 and then progressively unrolled into overlying contact with the covering layer 51. Thus, the sleeves 52 of the brushing rollers 41, 42 and 43 can be readily and economically replaced when they become worn.

Figure 5:
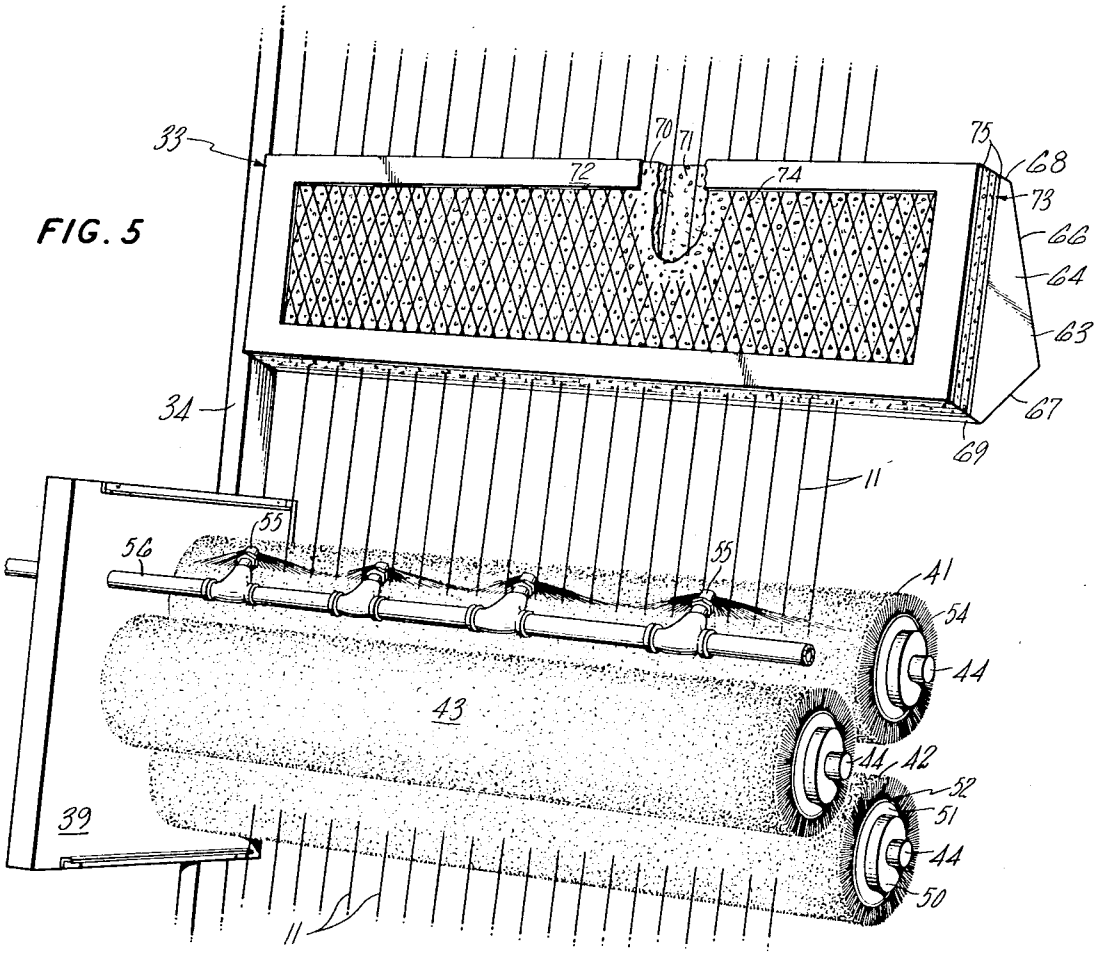
FIG. 5 is a perspective view of a portion of the fines removing apparatus.

As best shown in FIG. 5, the brush rollers 41, 42 and 43 are mounted transversely of the plane of advancement of the wires 11 for brushing contact with the wires. The brush rollers 41 and 42 are disposed at one side of the wires 11 and the brush roller 43 is disposed on the opposite side of the wires such that each wire advances past the brush rollers in a substantially straight line along the plane of wire advancement. The brush rollers are also arranged such that the brush roller 41 is in brushing contact with wires 11 along an area above the area of brushing contact between the brush roller 42 and the wires and such that the brush roller 43 is in brushing contact with the wires along an area intermediate the areas of brushing contact of the brush rollers 41 and 42 with the wires.

Four spray nozzles 55 are located in the chamber 27 and are directed to each deliver a fan-shaped spray of liquid against the wires 11 and the brush roller 41 at the area of brushing contact of the brush roller 41 with wires 11. The nozzles 55 are positioned to direct fan jets of liquid along a plane generally normal to the plane of advancement of the wires and are suitably spaced lengthwise of the brush roller 41 along a common header conduit 56 supported by the end walls 38 and 39 so that the entire length of the sleeve 52 on the brush roller 41 is thoroughly wetted by fan jets of the liquid. The liquid impinges upon the brush roller 41 to flush fines from the brush roller 41 and is deflected or cascades downwardly onto the other brush rollers 42 and 43 which are also thoroughly wetted by the liquid. The wetting of the fibers 54 on the brush rollers facilitate the brushing action of the brush rollers which all rotate in a direction opposite to the direction of advancement of the wires 11. The removal of copper fines from the brush rollers 41, 42 and 43 by the rinsing effect of the liquid is supplemented by rotation of the brush rollers at a speed sufficient to also throw off the liquid and the fines by centrifugal force.

The back of the housing 26 is closed by a back panel member 57 which has a sump portion 58 at its lower end extending below the bottom wall 30 for collecting the liquid discharged in the chamber 27 and the fines freed from the wires 11. A drain outlet 59 in the sump portion 58 is connected to a conduit 60 for draining of the liquid with the freed fines therein from the chamber 27 into the filter tank 36. The splashguard panel 24 serves as a spillway to deflect to the receptacle 25 the liquid escaping from the chamber 27 through the opening 32. A drain outlet 61 in the receptacle 25 is connected to a conduit 62 for draining of the liquid from the receptacle 25 into the filter tank 36.

The liquid wiping device 33 is disposed outside the housing 26 above the brush roller 41 and comprises a drain pan 63 formed by two generally triangular end walls 64 and 65 and by horizontally elongated rear walls 66 and 67 which converge rearwardly from narrow top and bottom walls 68 and 69 to a vertex. Two sheets 70 and 71 of soft elastic porous material such as a polyurethane sponge are retained in face-to-face engagement across the open face of the drain pan 63 by retention panels 73 and 73 each formed of a rectangular expanded metal screen 74 with its outer edges covered by a generally U-shaped metal edge guard 75. The outer retention panel 72 is preferably secured to the drain pan 63 to permit ready replacement of the sponge sheets 70 and 71 when they become worn.

The sponge sheets 70 and 71 are located with their opposed surfaces pressed together in face-to-face engagement along the plane of advancement of the wires 11 and in engagement with the wires 11 to at least partially encompass the wires 11 advancing between the sheets 70 and 71. The liquid wiped from the wires 11 at the lower ends of the sponge sheets 70 and 71 form into droplets that flow into the housing 26 through the upper opening 31 in the top wall 29. Other liquid wiped from the wires 11 and absorbed by the sponge sheets 70 and 71 drains into the drain pan 63. A drain outlet 76 in the drain pan 63 is connected to a conduit 77 for draining of the liquid from the drain pan 63 into the filter tank 36.

The liquid sprayed by the nozzles 55 upon the brush roller 41 is preferably deionized water which is continuously recirculated and filtered. A pump 78 supples liquid from the reservoir 37 to the header conduit 56 through a supply conduit 79 and a shutoff valve 80 at a suitable pressure indicated by a gauge 81. The supply conduit 79 is equipped with a fitting 82 that is connected to a return conduit 83 with a return dump valve 84 which is closed during normal operation but which may be opened to dump liquid supplied by the pump 78 into the filter tank 36.

Housed within the filter tank 36 is a filter bag 85 which is disposed below the discharge ends of the conduits 60, 62, 77 and 83. Fitted to the inner side of one wall of the filter tank 36 is a baffle 86 which overlies one end of a discharge conduit 87 leading from the filter tank 36 into the reservoir 37. An overflow outlet 88 may be fitted in one wall of the reservoir 37 and connected to a drain line (not shown). It will be seen that the liquid sprayed into the chamber 27 is returned to the filter tank 36 from the chamber 27, the receptacle 25 and the drain pan 63 by gravity. In the filter tank 36, liquid carrying fines removed from the wires 11 flows through the filter bag 85 wherein the fines are collected. The filtered liquid flows continuously from the filter tank 36 into the reservoir 37 from which it is delivered to the spray nozzles 55 by the pump 78.

In typical operation of the fines removing apparatus 10, a group of twenty copper wires 11 are simultaneously advanced through the apparatus at a linear speed of about 46 meters per minute. The brush rollers 41, 42 and 43 are all rotated in a direction opposite the direction of wire advancement at a speed of about 280 revolutions per minute. Deionized water is directed upon the wires 11 and the brush roller 41 by the nozzles 55 at a total flow rate of about 11.4 liters per minute. The fur-like hairs or fibers 54 of the brush rollers wiping along the wires 11 provide a smooth thorough cleaning of fines from the wires without causing any appreciable lateral displacement of the wires.

The effective cleaning action of the fines removing apparatus 10 results in substantially reduced scrap losses in the manufacture of magnet wire as compared with scrap losses occurring with the prior felt pad wiper type of fines removing equipment. The operating cost of the fines removing apparatus 10 is also lower since only the sponge sheets 70 and 71 need to be replaced on a daily basis. The sleeves 52 of the brush rollers may be replaced on a monthly basis and the filter bag 85 may be replaced every fifteen days. Furthermore, the problems resulting from collection of copper fines at the oven 16 and enamel applicator unit 17 and the cost of their removal are obviated by the present invention.

While there has been described above the principles of this invention in connection with a specific fines removing apparatus, it is to be understood that this description is made only by way of example and not as a limitation to the scope of the invention.

What is claimed is:

1. Apparatus for removing fines from the outer surfaces of a plurality of bare copper wires advancing generally upwardly in parallel, side-by-side relationship in a common plane and in the same direction, which apparatus comprises:

wire brushing means comprising first, second and third elongated brush rollers mounted transversely of the plane of advancement of the wires for brushing contact with the outer surfaces of the wires to remove fines therefrom; each of said rollers having a generally cylindrical outer brushing surface composed of a fur-like, fine pile material with radial fibrous hairs of a soft and flexible synthetic resin; said first and second rollers being disposed at one side of the plane of advancement of the wires and arranged in a spaced relationship such that said first roller is in brushing contact with the wires along an area above the area of brushing contact between the second roller and the wires; said third roller being disposed at the opposite side of the plane of advancement of the wires and arranged such that said third roller is in brushing contact with the wires along an area intermediate the areas of brushing contact of said first and second rollers with the wires; said rollers being mounted so that each of the wires advances past said rollers in a substantially straight line;

spray nozzle means disposed adjacent said first roller and directed to discharge a spray of liquid at the contact area between said first roller and the wires to flush fines from said first roller and to produce a flow of liquid onto said rollers which facilitates the brushing action of said rollers; and means for simultaneously rotating said three rollers at such a speed as to throw off by centrifugal force the fines removed from the wires by said rollers; each of said rollers being rotated in a direction opposite to the direction of advancement of the wires.

2. An apparatus according to claim 1 wherein said liquid is deionized water.

3. An apparatus according to claim 1 wherein said spray nozzle means comprise a plurality of nozzles positioned to direct fan jets of liquid at the contact area between said first roller and the wires along a plane generally normal to the plane of advancement of the wires.

4. An apparatus according to claim 1 further including liquid wiping means disposed above said first roller, said wiping means comprising:

a first sheet of soft elastic porous material having a wire-engaging surface disposed at one side of the plane of advancement of the wires;

a second sheet of soft elastic porous material having a wire-engaging surface disposed at the opposite side of the plane of advancement of the wires; and retention means for holding said first and second sheets together with said wire-engaging surfaces thereof in wire-engaging face-to-face engagement to partially encompass the wires advancing therebetween and to wipe and absorb liquid from the wires.

5. An apparatus according to claim 1 further comprising;

a housing defining a chamber within which said brush rollers and said spray nozzle means are disposed; said housing including top and bottom walls having respective aligned upper and lower openings therein for the passage through said chamber of the wires;

drain means for collecting liquid discharged from said chamber by said spray nozzle means and carrying fines freed from the wires;

filtering means operatively connected with said drain means for removing fines from the liquid collected by said drain means; and pump means operatively connected with said filtering means for delivering filtered liquid from said filtering means to said spray nozzle means.

6. An apparatus according to claim 5 wherein said drain means comprise:

sump means collecting liquid from within said chamber;

receptacle means disposed beneath said housing bottom wall;

and panel means extending generally downwardly from said lower opening in said housing bottom wall to said receptacle means in spaced relation to the plane of advancement of the wires to define a spillway and splashguard for liquid escaping from said chamber through said lower opening.

7. An apparatus according to claim 5 further including liquid wiping means disposed above said top housing wall to wipe and absorb liquid from the wires exiting from said chamber through said upper opening, said liquid wiping means comprising:

first and second sheets of soft elastic porous material having opposed wire-engaging surfaces disposed in face-to face engagement along the plane of advancement of the wires to partially encompass the wires advancing therebetween;

retention means for holding said first and second sheets together in wire-engaging face-to-face engagement; and drain pan means extending along one of said sheets to collect excess liquid absorbed by said sheets for return to said filtering means.

* * * * *